US006036022A

United States Patent [19]

Young

[11] Patent Number: 6,036,022

[45] Date of Patent: Mar. 14, 2000

[54] COMBINATION CONDOM CASE AND FRAGRANCE DISPENSER

[76] Inventor: Ronnie A. Young, 4540 Orange Ave. #211, Long Beach, Calif. 90807

[21] Appl. No.: 09/366,340

[22] Filed: Aug. 2, 1999

[51] Int. Cl.[7] ..... B65D 71/00

[52] U.S. Cl. ..... 206/581; 206/38.1; 206/69

[58] Field of Search ..... 206/216, 223, 206/581, 69, 823, 38, 38.1, 37

[56] References Cited

U.S. PATENT DOCUMENTS

| | | | |
|---|---|---|---|
| 4,925,033 | 5/1990 | Stoner | 206/69 |
| 5,427,233 | 6/1995 | Zinck et al. | 206/38 |

*Primary Examiner*—Jacob K. Ackun
*Attorney, Agent, or Firm*—Goldstein & Canino

[57] ABSTRACT

A combination condom case and fragrance dispenser including a housing having a generally rectangular configuration. The housing is defined by a top wall, a bottom wall, a front wall, a back wall, and opposed side walls. The front wall has an opening therein exposing a first compartment. One of the opposed side walls has an opening therein exposing a second compartment. A transparent flexible fragrance tube is slidably disposed within the first compartment. The tube has an open outer end directed outwardly of the opening in the front wall. The open outer end is defined by a plurality of small orifices. The tube holds a quantity of perfume therein. A plunger is disposed within the top wall of the housing above the first compartment. The plunger is adapted for downward urging for applying downward pressure on the flexible fragrance tube to effect outward spraying of the perfume outwardly of the open outer end of the tube. A condom is disposed within the second compartment of the housing.

7 Claims, 2 Drawing Sheets

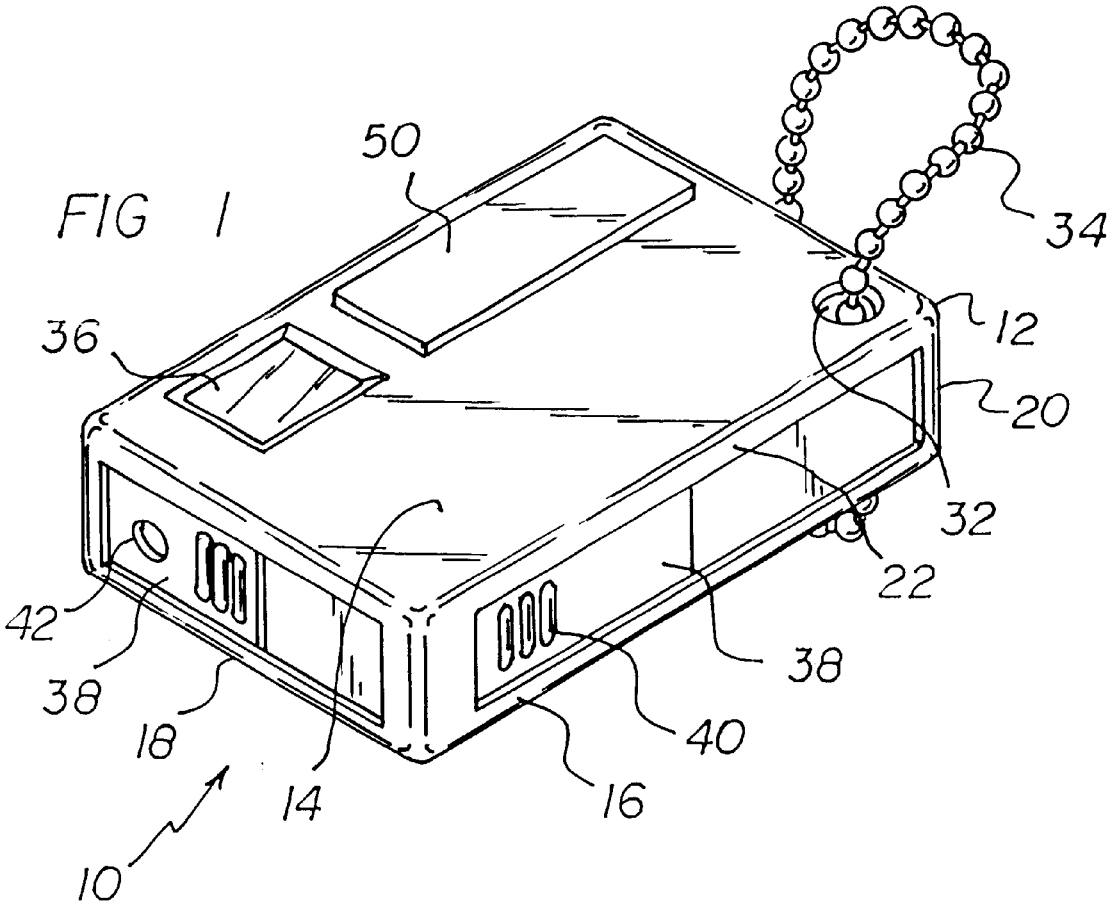
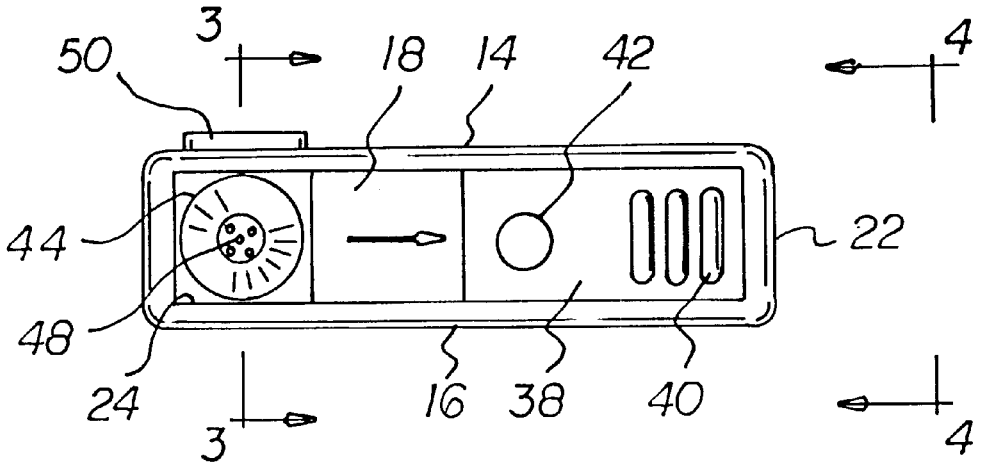
FIG 2

FIG 3
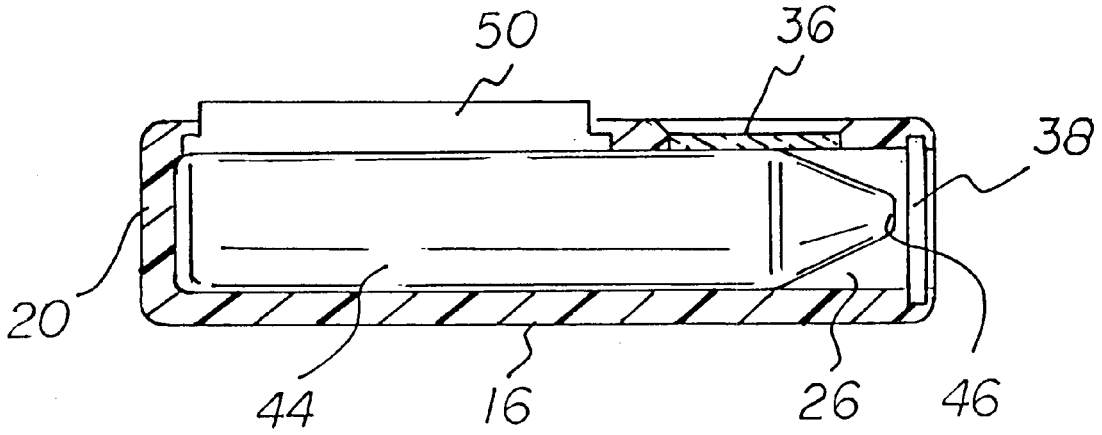
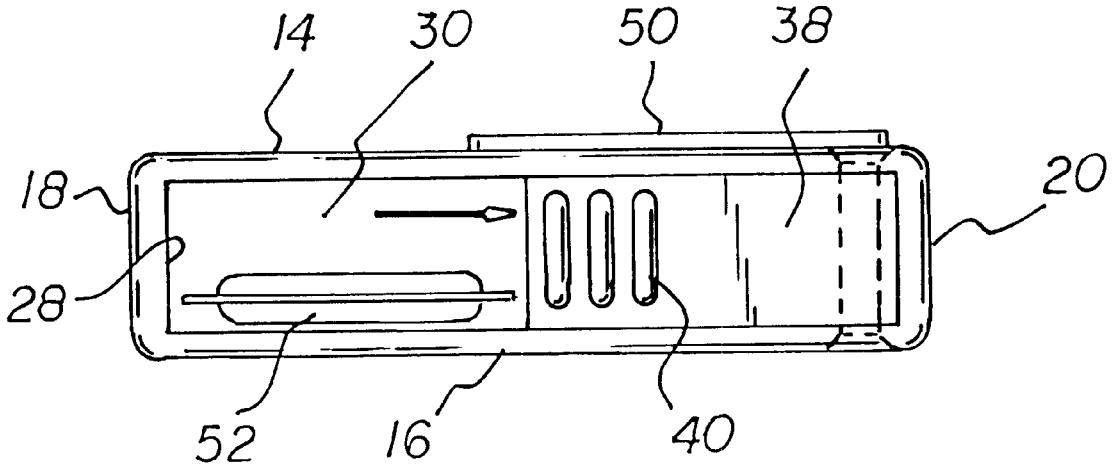
FIG 4

COMBINATION CONDOM CASE AND FRAGRANCE DISPENSER

BACKGROUND OF THE INVENTION

The present invention relates to a combination condom case and fragrance dispenser and more particularly pertains to holding a condom and fragrance for convenient use.

The existence of AIDS and other sexually transmitted diseases necessitates the need for a condom when having casual sex. Sometimes, a person does not have a condom with them at the appropriate time and often will have unprotected sex. What is needed is a convenient device that will allow a person to a carry a condom with them at all times.

The present invention attempts to solve the abovementioned problem by providing a device that is attachable to one's keys that includes a compartment for holding a condom. Additionally, the device will also have a separate compartment for holding perfume or cologne that can be sprayed at the user's option.

The use of combination holding devices is known in the prior art. More specifically, combination holding devices heretofore devised and utilized for the purpose of holding numerous objects are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,741,434 to Liebman discloses a key holder with a condom holding keychain device. U.S. Pat. No. Des. 329,136 to Sanchez discloses an ornamental design for a condom holding keychain device. U.S. Pat. No. 5,156,275 to Murray, Sr. discloses a compact with a bottle and a number of compartments and includes a key ring attachment. U.S. Pat. No. 5,289,915 to Queen discloses a keyring with a container with two containers incorporated. U.S. Pat. No. Des. 288,468 to Ruttinger discloses an ornamental design for keys and a protective spray.

While these devices fulfill their respective, particular objective and requirements, the aforementioned patents do not describe a combination condom case and fragrance dispenser for holding a condom and fragrance for convenient use.

In this respect, the combination condom case and fragrance dispenser according to the present invention substantially departs from the conventional concepts and designs of the prior art, and in doing so provides an apparatus primarily developed for the purpose of holding a condom and fragrance for convenient use.

Therefore, it can be appreciated that there exists a continuing need for new and improved combination condom case and fragrance dispenser which can be used for holding a condom and fragrance for convenient use. In this regard, the present invention substantially fulfills this need.

SUMMARY OF THE INVENTION

In the view of the foregoing disadvantages inherent in the known types of combination holding devices now present in the prior art, the present invention provides an improved combination condom case and fragrance dispenser. As such, the general purpose of the present invention, which will be described subsequently in greater detail, is to provide a new and improved combination condom case and fragrance dispenser and method which has all the advantages of the prior art and none of the disadvantages.

To attain this, the present invention essentially comprises a housing having a generally rectangular configuration, the housing being defined by a top wall, a bottom wall, a front wall, a back wall, and opposed side walls. The front wall has an opening therein exposing a first compartment. One of the opposed side walls has an opening therein exposing a second compartment. The housing has an aperture through the top wall and the bottom wall. The aperture receives a key chain therethrough. The top wall has a clear window disposed therein above the first compartment. The openings for the first and second compartment each have a door slidably disposed thereover. Each of the doors have grips disposed thereon. The door for the first compartment has an opening therethrough which will align with the opening in the front wall when the door is in a closed orientation. A transparent flexible fragrance tube is slidably disposed within the first compartment. The tube has an open outer end directed outwardly of the opening in the front wall. The open outer end is defined by a plurality of small orifices. The tube holds a quantity of perfume therein. A plunger is disposed within the top wall of the housing above the first compartment. The plunger is adapted for downward urging for applying downward pressure on the flexible fragrance tube to effect outward spraying of the perfume outwardly of the open outer end of the tube. A condom is disposed within the second compartment of the housing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved combination condom case and fragrance dispenser which has all the advantages of the prior art combination holding devices and none of the disadvantages.

It is another object of the present invention to provide a new and improved combination condom case and fragrance dispenser which may be easily and efficiently manufactured and marketed.

It is a further object of the present invention to provide a new and improved combination condom case and fragrance dispenser which is of durable and reliable construction.

An even further object of the present invention is to provide a new and improved combination condom case and fragrance dispenser which is susceptible of a low cost of manufacture with regard to both materials and labor, and which accordingly is then susceptible of low prices of sale to the consuming public, thereby making such a combination condom case and fragrance dispenser economically available to the buying public.

Even still another object of the present invention is to provide a new and improved combination condom case and fragrance dispenser for holding a condom and fragrance for convenient use.

Lastly, it is an object of the present invention to provide a new and improved combination condom case and fragrance dispenser including a housing having a generally rectangular configuration, the housing being defined by a top wall, a bottom wall, a front wall, a back wall, and opposed side walls. The front wall has an opening therein exposing a first compartment. One of the opposed side walls has an opening therein exposing a second compartment. A transparent flexible fragrance tube is slidably disposed within the first compartment. The tube has an open outer end directed outwardly of the opening in the front wall. The open outer end is defined by a plurality of small orifices. The tube holds a quantity of perfume therein. A plunger is disposed within the top wall of the housing above the first compartment. The plunger is adapted for downward urging for applying downward pressure on the flexible fragrance tube to effect outward spraying of the perfume outwardly of the open outer end of the tube. A condom is disposed within the second compartment of the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the combination condom case and fragrance dispenser constructed in accordance with the principles of the present invention.

FIG. 2 is a front end view of the present invention.

FIG. 3 is a cross-sectional view of the present invention as taken along line 3—3 of FIG. 2.

FIG. 4 is a side view of the present invention as taken along line 4—4 of FIG. 2.

The same reference numerals refer to the same parts through the various figures.

DESCRIPTION OF THE PREFERRED EMBODIMENT

With reference now to the drawings, and in particular, to FIGS. 1 through 4 thereof, the preferred embodiment of the new and improved combination condom case and fragrance dispenser embodying the principles and concepts of the present invention and generally designated by the reference number 10 will be described.

Specifically, it will be noted in the various Figures that the device relates to a combination condom case and fragrance dispenser for holding a condom and fragrance for convenient use. In its broadest context, the device consists of a housing, a transparent flexible fragrance tube, a plunger, and a condom. Such components are individually configured and correlated with respect to each other so as to attain the desired objective.

The housing 12 has a generally rectangular configuration. The housing 12 is defined by a top wall 14, a bottom wall 16, a front wall 18, a back wall 20, and opposed side walls 22. The front wall 18 has an opening 24 therein exposing a first compartment 26. One of the opposed side walls 22 has an opening 28 therein exposing a second compartment 30. The housing 12 has an aperture 32 through the top wall 14 and the bottom wall 16. The aperture 32 receives a key chain 32 therethrough. The top wall 14 has a clear window 36 disposed therein above the first compartment 26. The openings for the first and second compartment 26, 30 each have a door 38 slidably disposed thereover. Each of the doors 38 have grips 40 disposed thereon. The door 38 for the first compartment 26 has an opening 42 therethrough which will align with the opening 24 in the front wall 18 when the door 38 is in a closed orientation.

The transparent flexible fragrance tube 44 is slidably disposed within the first compartment 26. The tube 44 has an open outer end 46 directed outwardly of the opening 24 in the front wall 18. The open outer end 46 is defined by a plurality of small orifices 48. The tube 44 holds a quantity of perfume therein. The tube 44 can be replaced when the perfume or cologne has run out. The user can see how much perfume remains in the tube 44 by looking through the clear window 36.

The plunger 50 is disposed within the top wall 14 of the housing 12 above the first compartment 26. The plunger 50 is adapted for downward urging for applying downward pressure on the flexible fragrance tube 44 to effect outward spraying of the perfume outwardly of the open outer end 46 of the tube 44. Optionally, the plunger 50 could be provided with a spring to effect the outward urging of the plunger 50 when not in use so as to accidentally discharge the perfume.

The condom 52 is disposed within the second compartment 30 of the housing 12. The second compartment 52 is specifically designed to accommodate a condom 52. Note FIG. 4.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A combination condom case and fragrance dispenser for holding a condom and fragrance for convenient use comprising, in combination:

a housing having a generally rectangular configuration, the housing being defined by a top wall, a bottom wall, a front wall, a back wall, and opposed side walls, the front wall having an opening therein exposing a first compartment, one of the opposed side walls having an opening therein exposing a second compartment, the housing having an aperture through the top wall and the bottom wall, the aperture receiving a key chain therethrough, the top wall having a clear window disposed therein above the first compartment, the openings for the first and second compartment each having a door slidably disposed thereover, each of the doors having grips disposed thereon, the door for the first compartment having an opening therethrough which will align with the opening in the front wall when the door is in a closed orientation;

a transparent flexible fragrance tube slidably disposed within the first compartment, the tube having an open outer end directed outwardly of the opening in the front wall, the open outer end being defined by a plurality of small orifices, the tube holding a quantity of perfume therein;

a plunger disposed within the top wall of the housing above the first compartment, the plunger being adapted for downward urging for applying downward pressure on the flexible fragrance tube to effect outward spraying of the perfume outwardly of the open outer end of the tube;

a condom disposed within the second compartment of the housing.

2. A combination condom case and fragrance dispenser for holding a condom and fragrance for convenient use comprising, in combination:

a housing having a generally rectangular configuration, the housing being defined by a top wall, a bottom wall, a front wall, a back wall, and opposed side walls, the front wall having an opening therein exposing a first compartment, one of the opposed side walls having an opening therein exposing a second compartment;

a transparent flexible fragrance tube slidably disposed within the first compartment, the tube having an open outer end directed outwardly of the opening in the front wall, the open outer end being defined by a plurality of small orifices, the tube holding a quantity of perfume therein;

a plunger disposed within the top wall of the housing above the first compartment, the plunger being adapted for downward urging for applying downward pressure on the flexible fragrance tube to effect outward spraying of the perfume outwardly of the open outer end of the tube;

a condom disposed within the second compartment of the housing.

3. The combination condom case and fragrance dispenser as set forth in claim 2 wherein the housing has an aperture through the top wall and the bottom wall, the aperture receiving a key chain therethrough.

4. The combination condom case and fragrance dispenser as set forth in claim 2 wherein the top wall of the housing has a clear window disposed therein above the first compartment.

5. The combination condom case and fragrance dispenser as set forth in claim 2 wherein the openings for the first and second compartment each having a door slidably disposed thereover.

6. The combination condom case and fragrance dispenser as set forth in claim 5 wherein each of the doors have grips disposed thereon.

7. The combination condom case and fragrance dispenser as set forth in claim 5 wherein the door for the first compartment has an opening therethrough which will align with the opening in the front wall when the door is in a closed orientation.

* * * * *